US006995711B2

(12) United States Patent
Killen et al.

(10) Patent No.: US 6,995,711 B2
(45) Date of Patent: Feb. 7, 2006

(54) HIGH EFFICIENCY CROSSED SLOT MICROSTRIP ANTENNA

(75) Inventors: William D. Killen, Melbourne, FL (US); Randy T. Pike, Grant, FL (US); Heriberto Jose Delgado, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 92 days.

(21) Appl. No.: 10/404,960

(22) Filed: Mar. 31, 2003

(65) Prior Publication Data

US 2004/0189527 A1 Sep. 30, 2004

(51) Int. Cl.
*H01Q 1/38* (2006.01)

(52) U.S. Cl. ..... 343/700 MS

(58) Field of Classification Search ..... 343/700 MS, 343/846, 878, 848, 829, 830
See application file for complete search history.

(56) References Cited

U.S. PATENT DOCUMENTS

| | | | | |
|---|---|---|---|---|
| 3,571,722 | A | | 3/1971 | Vendelin |
| 3,581,243 | A | | 5/1971 | Alford |
| 3,678,418 | A | | 7/1972 | Woodward |
| 3,681,716 | A | | 8/1972 | Chiron et al. |
| 4,495,505 | A | | 1/1985 | Shields |
| 4,525,720 | A | | 6/1985 | Corzine et al. |
| 4,638,271 | A | | 1/1987 | Jecko et al. |
| 4,800,344 | A | | 1/1989 | Graham |
| 4,825,220 | A | | 4/1989 | Edward et al. |
| 4,882,553 | A | | 11/1989 | Davies et al. |
| 4,916,410 | A | | 4/1990 | Littlefield |
| 4,924,236 | A | | 5/1990 | Schuss et al. |
| 4,967,171 | A | | 10/1990 | Ban et al. |
| 5,039,891 | A | | 8/1991 | Dietrich |
| 5,148,130 | A | | 9/1992 | Wen et al. |
| 5,379,006 | A | | 1/1995 | McCorkle |
| 5,455,545 | A | | 10/1995 | Garcia |
| 5,515,059 | A | * | 5/1996 | How et al. ..... 342/372 |
| 5,523,728 | A | | 6/1996 | McCorkle |
| 5,668,558 | A | * | 9/1997 | Hong ..... 343/700 MS |
| 5,678,219 | A | | 10/1997 | Agarwal et al. |
| 5,714,112 | A | | 2/1998 | Hazeyama et al. |
| 5,952,972 | A | * | 9/1999 | Ittipiboon et al. ... 343/700 MS |
| 6,052,039 | A | | 4/2000 | Chiou et al. |
| 6,114,940 | A | | 9/2000 | Kakinuma et al. |

(Continued)

FOREIGN PATENT DOCUMENTS

EP 0 754 660 A1 1/1997

(Continued)

OTHER PUBLICATIONS

U.S. Appl. No. 10/448,973, filed May 30, 2003, Delgado et al.

(Continued)

*Primary Examiner*—Tuyet Vo
*Assistant Examiner*—Huedung X. Cao
(74) *Attorney, Agent, or Firm*—Sacco & Associates, PA

(57) ABSTRACT

A crossed slot fed microstrip antenna (100). The antenna (100) includes a conducting ground plane (125), which has at least one crossed slot (125), and at least two feed lines (105). The feed lines (105) have respective stub regions (115) that extend beyond the crossed slot (125) and transfer signal energy to or from the crossed slot (125). The antenna (100) also includes a first substrate (150) disposed between the ground plane (120) and the feed lines (105). The first substrate (150) includes a first region and at least a second region, the regions having different substrate properties. The first region is proximate to at least one of the feed lines (105).

11 Claims, 3 Drawing Sheets

U.S. PATENT DOCUMENTS

| | | | | |
|---|---|---|---|---|
| 6,133,806 | A | 10/2000 | Sheen | |
| 6,137,376 | A | 10/2000 | Imbornone et al. | |
| 6,184,845 | B1 | 2/2001 | Leisten et al. | |
| 6,211,825 | B1 * | 4/2001 | Deng | 343/700 MS |
| 6,239,762 | B1 * | 5/2001 | Lier | 343/770 |
| 6,281,845 | B1 * | 8/2001 | Ittipiboon et al. | 343/700 MS |
| 6,307,509 | B1 | 10/2001 | Krantz | |
| 6,731,244 | B2 * | 5/2004 | Killen et al. | 343/700 MS |

FOREIGN PATENT DOCUMENTS

| | | |
|---|---|---|
| EP | 1 089 374 A2 | 4/2001 |
| EP | 1 108 533 | 6/2001 |
| JP | 56-123102 | 9/1981 |
| JP | 05-211402 | 8/1983 |
| JP | 07-015218 | 1/1995 |
| JP | 08-154006 | 6/1996 |
| JP | 08 307117 | 11/1996 |
| JP | 10/190321 | 7/1998 |
| JP | 2000307362 | 11/2000 |
| WO | WO 01-01453 A2 | 1/2001 |

OTHER PUBLICATIONS

U.S. Appl. No. 10/184,277, filed Jun. 27, 2002, Killen et al.
U.S. Appl. No. 10/185,443, filed Jun. 27, 2002, Killen et al.
U.S. Appl. No. 10/184,332, filed Jun. 27, 2002, Killen et al.
U.S. Appl. No. 10/185,251, filed Jun. 27, 2002, Parsche et al.
U.S. Appl. No. 10/185,847, filed Jun. 27, 2002, Killen et al.
U.S. Appl. No. 10/185,275, filed Jun. 27, 2002, Killen et al.
U.S. Appl. No. 10/185,273, filed Jun. 27, 2002, Killen et al.
U.S. Appl. No. 10/308,500, filed Dec. 3, 2002, Killen et al.
U.S. Appl. No. 10/373,935, filed Feb. 25, 2003, Killen et al.
U.S. Appl. No. 10/404,285, filed Mar. 31, 2003, Killen et al.
U.S. Appl. No. 10/404,981, filed Mar. 31, 2003, Killen et al.
U.S. Appl. No. 10/185,144, filed Jun. 27, 2002, Killen et al.
U.S. Appl. No. 10/185,266, filed Jun. 27, 2002, Killen et al.
U.S. Appl. No. 10/185,162, filed Jun. 27, 2002, Rumpf, Jr., et al.
U.S. Appl. No. 10/185,824, filed Jun. 27, 2002, Killen et al.
U.S. Appl. No. 10/185,187, filed Jun. 27, 2002, Killen et al.
U.S. Appl. No. 10/185,855, filed Jun. 27, 2002, Killen et al.
U.S. Appl. No. 10/185,459, filed Jun. 27, 2002, Killen et al.
U.S. Appl. No. 10/185,480, filed Jun. 27, 2002, Killen et al.
U.S. Appl. No. 10/439,094, filed May 15, 2003, Delgado et al.
Itoh, T.; et al: "Metamaterials Structures, Phenomena and Applications" IEEE Transactions on Microwave Theory and Techniques; Apr., 2005; Online Retrieved from the Internet: URL:www.mtt.org/publications/Transactions/CFP__Metamaterials.pdf>.
Kiziltas, G.; et al: "Metamaterial design via the density method" IEEE Antennas and Propagation Society Int'l Symposium 2002, vol. 1, Jun. 16, 2002 pp 748-751, Piscataway.
Salahun, E.; et al: "Ferromagnetic composite-based and magnetically-tunable microwave devices" IEEE MTT-S Microwave Symposium Digest, vol. 2, Jun. 2, 2002 pp1185-1188.

* cited by examiner

HIGH EFFICIENCY CROSSED SLOT MICROSTRIP ANTENNA

BACKGROUND OF THE INVENTION

1. Statement of the Technical Field

The inventive arrangements relate generally to microstrip antennas and more particularly to crossed slot fed microstrip antennas.

2. Description of the Related Art

RF circuits, transmission lines and antenna elements are commonly manufactured on specially designed substrate boards. Conventional circuit board substrates are generally formed by processes such as casting or spray coating which typically result in uniform substrate physical properties, including the dielectric constant.

For the purposes RF circuits, it is generally important to maintain careful control over impedance characteristics. If the impedance of different parts of the circuit do not match, signal reflections and inefficient power transfer can result. Electrical length of transmission lines and radiators in these circuits can also be a critical design factor.

Two critical factors affecting circuit performance relate to the dielectric constant (sometimes referred to as the relative permittivity or $\epsilon_r$) and the loss tangent (sometimes referred to as the dissipation factor) of the dielectric substrate material. The relative permittivity, or dielectric constant, determines the propagation velocity of a signal in the substrate material, and therefore the electrical length of transmission lines and other components disposed on the substrate. The loss tangent determines the amount of loss that occurs for signals traversing the substrate material. Losses tend to increase with increases in frequency. Accordingly, low loss materials become even more important with increasing frequency, particularly when designing receiver front ends and low noise amplifier circuits.

Printed transmission lines, passive circuits and radiating elements used in RF circuits can be formed in many different ways. One configuration known as microstrip, places the signal line on a board surface and provides a second conductive layer, commonly referred to as a ground plane. A second type of configuration known as buried microstrip is similar except that the signal line is covered with a dielectric substrate material. In a third configuration known as stripline, the signal line is sandwiched between two electrically conductive (ground) planes.

Ignoring loss, the characteristic impedance of a transmission line, such as stripline or microstrip, is approximately equal to $\sqrt{L_1/C_1}$, where $L_1$ is the inductance per unit length and $C_1$ is the capacitance per unit length. The values of $L_1$ and $C_1$ are generally determined by the physical geometry and spacing of the line structure as well as the permittivity and permeability of the dielectric material(s) used to separate the transmission lines. Conventional substrate materials typically have a relative permeability of approximately 1.0.

In conventional RF designs, a substrate material is selected that has a single relative permittivity value and a single relative permeability value, the relative permeability value being about 1. Once the substrate material is selected, the line characteristic impedance value is generally exclusively set by controlling the geometry of the line.

Radio frequency (RF) circuits are typically embodied in hybrid circuits in which a plurality of active and passive circuit components are mounted and connected together on a surface of an electrically insulating board substrate, such as a ceramic substrate. The various components are generally interconnected by printed metallic conductors, such as copper, gold, or tantalum, which generally function as transmission lines (e.g. stripline or microstrip or twin-line) in the frequency ranges of interest. As noted, one problem encountered when designing microelectronic RF circuitry is the selection of a dielectric board substrate material that is reasonably suitable for all of the various passive components, radiating elements and transmission line circuits to be formed on the board.

In particular, the geometry of certain circuit elements may be physically large or miniaturized due to the unique electrical or impedance characteristics required for such elements. For example, many circuit elements or tuned circuits may need to be an electrical ¼ wave. Similarly, the line widths required for exceptionally high or low characteristic impedance values can, in many instances, be too narrow or too wide for practical implementation for a given substrate. Since the physical size of the microstrip or stripline is inversely related to the relative permittivity of the dielectric material, the dimensions of a transmission line or a radiator element can be affected greatly by the choice of substrate board material.

Still, an optimal board substrate material design choice for some components may be inconsistent with the optimal board substrate material for other components, such as antenna elements. Moreover, some design objectives for a circuit component may be inconsistent with one another. For example, it may be desirable to reduce the size of an antenna element. This could be accomplished by selecting a board material with a high relative permittivity, such as 50 to 100. However, the use of a dielectric with a high relative permittivity will generally result in a significant reduction in the radiation efficiency of the antenna.

Antenna elements are sometimes configured as microstrip antennas. Microstrip antennas are useful antennas since they generally require less space, are simpler, and are generally less expensive to manufacture as compared to other antenna types. In addition, importantly, microstrip antennas are highly compatible with printed-circuit technology.

One factor in constructing a high efficiency microstrip antenna is minimizing power loss, which may be caused by several factors including dielectric loss. Dielectric loss is generally due to the imperfect behavior of bound charges, and exists whenever a dielectric material is placed in a time varying electrical field. Dielectric loss generally increases with operating frequency. For example, the extent of dielectric loss for a microstrip patch antenna is primarily determined by the dielectric constant of the dielectric space between the radiator patch and the ground plane. Free space, or air for most purposes, has a relative dielectric constant approximately equal to one.

A dielectric material having a relative dielectric constant close to one is considered a "good" dielectric material. A good dielectric material exhibits low dielectric loss at the operating frequency of interest. Hence, when a dielectric material having a relative dielectric constant substantially equal to unity is used, the dielectric loss is effectively eliminated. Therefore, one method for maintaining high efficiency in a microstrip patch antenna system involves the use of a material having a low relative dielectric constant in the space between the radiator patch and the ground plane.

Furthermore, the use of a material with a lower relative dielectric constant permits the use of wider transmission lines that, in turn, reduce conductor losses and further improve the radiation efficiency of the microstrip antenna. However, the use of a dielectric material having a low dielectric constant can present certain disadvantages, such as the inability to efficiently focus radiated power from the feed line through the slot for slot fed antennas.

Microstrip antennas are sometimes designed to emit multi-polarizations, such as when a circularly polarized output is desired. Dual polarizations and quad polarizations are commonly used. In these cases, a crossed slot configuration may be formed. For example, two feed lines, each driving separate slots of the crossed slot can be phased 90 degrees apart to produce a circularly polarized output. Improved balance can be realized by driving the crossed slot with four feed lines, the feed lines phased 90 degrees apart from their nearest neighbors.

Unfortunately, the performance of crossed slot microstrip antennas is compromised through selection of a particular dielectric material which has a single uniform dielectric constant. A low dielectric constant is helpful to allow wider feed lines, and as a result lower resistive loss, and minimize dielectric induced line loss. However, a low dielectric constant dielectric material in the junction region between the slot and the feed generally results in poor antenna radiation efficiency due to poor coupling characteristics through the slot. As a result, a conventional dielectric material selected must necessarily compromise either the loss characteristics or the efficiency of the antenna.

SUMMARY OF THE INVENTION

The present invention relates to a crossed slot fed microstrip antenna. The antenna includes a conducting ground plane, which has at least one crossed slot. The antenna further includes at least two feed lines. The feed lines have respective stub regions that extend beyond the crossed slot and transfer signal energy to or from the crossed slot. The feed lines are phased to provide a multi-polarization emission pattern.

The antenna also includes a first substrate disposed between the ground plane and the feed lines. The first substrate includes a first region and at least a second region. The first region has different substrate properties than the second region and is proximate to at least one of the feed lines. The substrate properties include permittivity and permeability. The permeability and/or permittivity in the first region can be higher or lower than the permeability and/or permittivity in the second region. Further, magnetic particles can be used to adjust permeability in any of the substrate regions. For example, the permeability in the first region can be about 1 and the permeability in the second region can be between 1 and 10.

The antenna can include a radiator patch positioned above the ground plane with a second substrate sandwiched between the radiator patch and the ground plane. The second substrate can also include magnetic particles. Additional radiator patches and substrates can be used as well.

DETAILED DESCRIPTION OF THE PREFERRED EMBODIMENTS

A crossed slot fed microstrip antenna has reduced size, but provides increased efficiency. The crossed slot fed microstrip antenna may also provide enhanced bandwidth. The improved microstrip antenna is formed by locally controlling the effective permittivity and/or effective permeability of one or more dielectric layer portions comprising the antenna.

Low dielectric constant board materials are ordinarily selected for RF designs. For example, polytetrafluoroethylene (PTFE) based composites such as RT/duroid® 6002 (dielectric constant of 2.94; loss tangent of 0.009) and RT/duroid® 5880 (dielectric constant of 2.2; loss tangent of 0.0007) are both available from Rogers Microwave Products, Advanced Circuit Materials Division, 100 S. Roosevelt Ave, Chandler, Ariz. 85226. Both of these materials are common board material choices. The above board materials are uniform across the board area in terms of thickness and physical properties and provide dielectric layers having relatively low dielectric constants with accompanying low loss tangents. The relative permeability of both of these materials is nearly 1.

Prior art antenna designs utilize uniform dielectric materials. Uniform dielectric properties generally compromise antenna performance due to trade-offs associated with selecting a single dielectric to suit various antenna circuit portions. A low dielectric constant substrate is preferred for transmission lines due to loss considerations and for antenna radiation efficiency, while a high dielectric constant substrate is preferred to minimize antenna size and to optimize energy coupling. Thus, trade-offs often result in inefficient antenna designs, including slot fed microstrip antennas.

Even when separate substrates are used for the antenna and the feed, the uniform dielectric properties of the dielectric substrates still generally compromise antenna performance. For example, for slot fed antennas, a low dielectric constant substrate reduces feed line loss but results in poor energy transfer efficiency between the feed line and the slot.

By comparison, the present invention provides the circuit designer with an added level of flexibility by permitting use of dielectric layers, or portions thereof, with selectively controlled permittivity and permeability properties. This permits the efficiency, functionality and physical profile of the antenna to be optimized.

The controllable and localizable dielectric and magnetic characteristics of dielectric substrates may be realized by including meta-materials in the dielectric substrate. Meta-materials refers to composite materials formed from the mixing of two or more different materials at a very fine level, such as the molecular or nanometer level.

Figure 1:
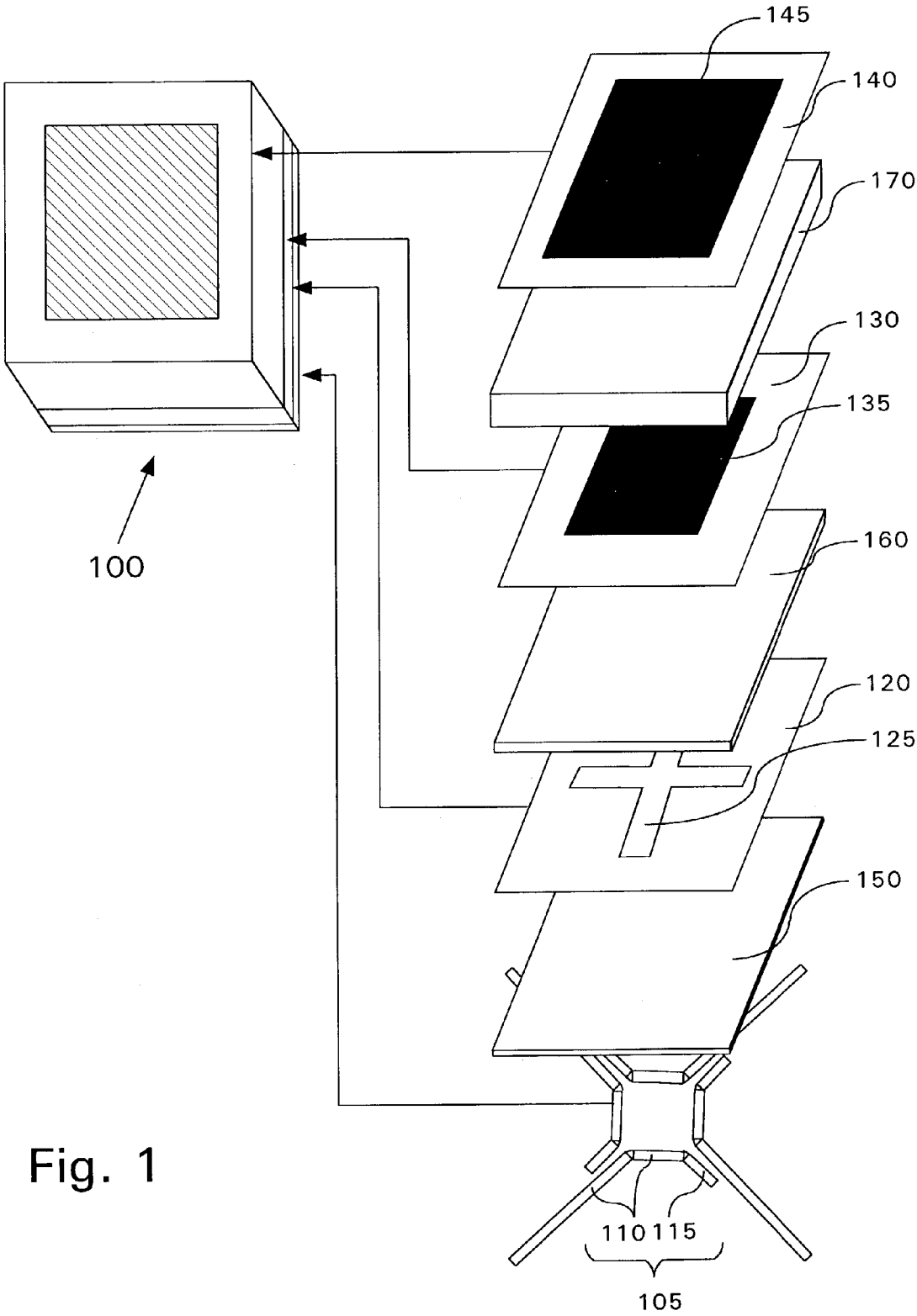
FIG. 1 is an isometric view of a crossed slot microstrip patch antenna formed on a substrate for reducing a size of the antenna, and improving coupling characteristics and bandwidth of the antenna in accordance with the present invention.

According to the present invention, a crossed slot fed microstrip antenna design is presented that has improved efficiency and bandwidth over prior art crossed slot fed microstrip antenna designs. Referring to FIG. 1, an isometric view of a crossed slot fed microstrip patch antenna (antenna) 100 according to an embodiment of the invention is presented. The antenna 100 includes two or more feed lines 105 which transfer signal energy to or from the feed line through a slot 125. Feed lines 105 comprise first portions 110 and stub portions 115. In a preferred embodiment four antenna feed lines 105 are used, as shown in FIG. 1. The antenna feed lines 105 may be a microstrip line or other suitable feed configuration and may be driven by a variety of sources via a suitable connector and interface.

The antenna 100 further includes a ground plane 120 having a crossed slot 125. The crossed slot 125 is provided to permit generation of multi-polarization signals, for example dual polarization. The slots may generally be any shape that provides adequate coupling between first portions 110 and slot 125. For example, slots having multiple rectangular or annular sections can be provided. The ground plane 120 is insulated from the antenna feed lines 105 by the first substrate layer 150, which is described in more detail below.

Optionally, a first patch substrate 130 having a first radiator patch 135 can be provided. The first radiator patch 135 can be separated from the ground plane by a second substrate layer 160. A second patch substrate 140 having a second radiator patch 145 can be provided as well, being separated from the first radiator patch 135 by a third substrate layer 170. The radiator patches 135 and 145 can be metalized regions on the respective substrates 130 and 140. In operation, the feed lines 105 can transfer signal energy to or from the radiator patches 135 and 145 through the crossed slot 125.

Importantly, the radiator patches 135 and 145 are not necessary for operation of the antenna. However, patches can be added to improve certain antenna propagation characteristics, as would be known to the skilled artisan. For example, the radiator patches 135 and 145 can improve antenna efficiency and provide enhanced circular polarization patterns over slotted microstrip antennas not having patches.

Figure 2:
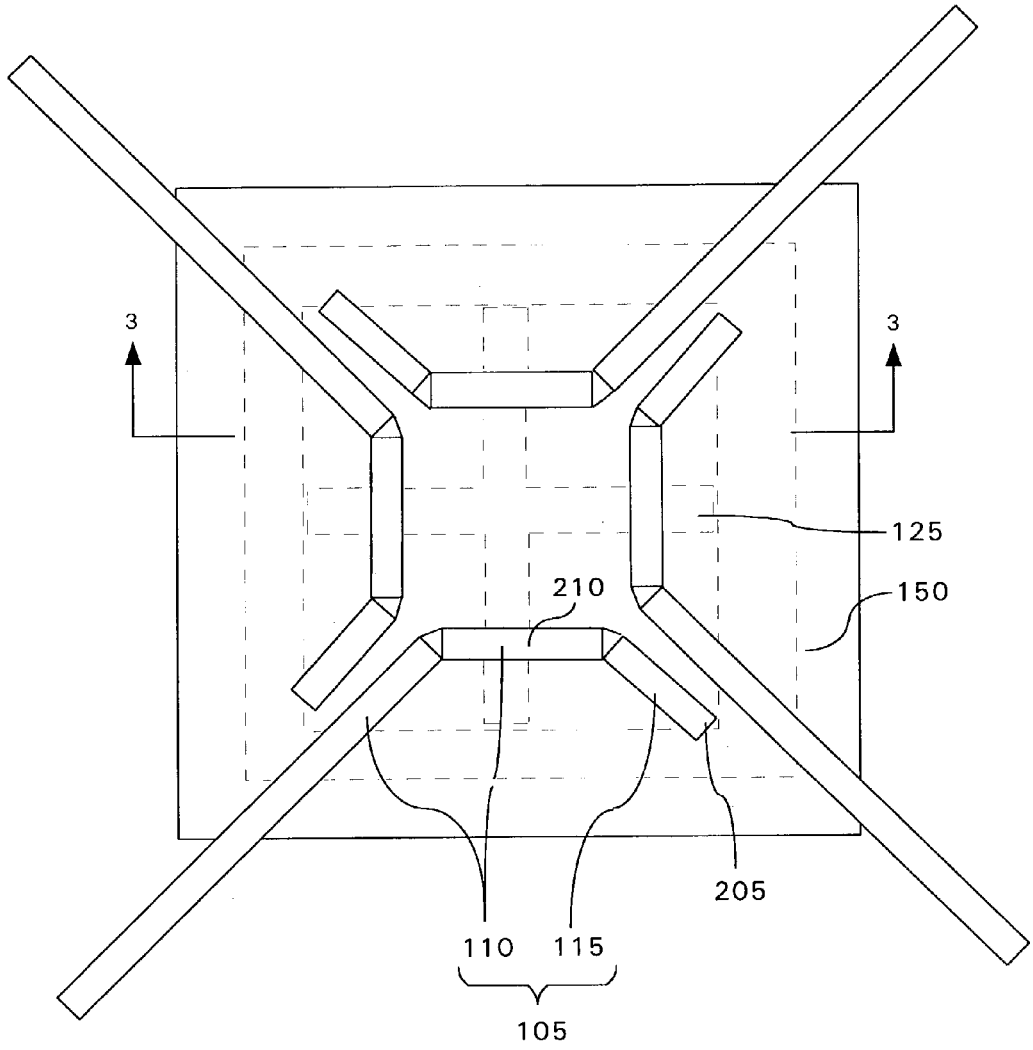
FIG. 2 is the bottom view of a slot fed microstrip patch antenna of FIG. 1.

Referring to FIG. 2, the first portions 110 of feed lines 105 transfer RF signal energy to or from the crossed slot 125. The first portions 110 also can transfer signal energy to or from the radiator patches 135 and 145 through the crossed slot 125, the second substrate layer 160, and the third substrate layer 170, if present. Stub portions 115 are the sections of antenna element 105 as measured from the distal end of the antenna elements 205 to the intersection 210 of the antenna feed lines 105 with the crossed slot 125. The stub lengths are typically tuned to maximize energy transfer by creating a standing wave along the length of the feed lines 105, which can permit positioning voltage maximums on the feed lines 105 over the crossed slot 125. For example, the stub lengths can be tuned to be approximately one-half of a wavelength at the operational frequency when the distal end 205 of the stub portions 115 are an open circuit. If the distal ends 205 of the stub portions 115 are shorted to ground, the optimum length of the stubs are generally approximately one-quarter wavelength at the operational frequency.

Figure 3:
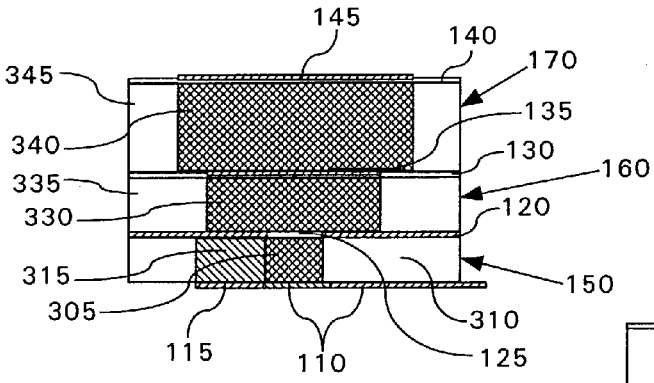
FIG. 3 is a section view of the slot fed microstrip patch antenna of FIG. 1 taken along section line 3—3 (with only one feed line shown for clarity).

Referring to FIG. 3, a section view of the crossed slot fed microstrip patch antenna is shown (with only one feed line 105 shown for clarity). The first substrate layer 150 is preferably thin to result in strong coupling between the feed lines and the crossed slot 125. For example, the thickness of the substrate layer 150 can be less than one-tenth of a wavelength of the antenna operational frequency.

The first substrate layer includes a first region 305 having a first set of substrate properties, and at least a second region 310 having a second set of substrate properties. The first set of substrate properties are different from the second set of substrate properties. First region 305 is disposed between the crossed slot 125 and first portions 110 of feed lines 105.

The relative permeability and/or permittivity in the first substrate region 305 is preferably higher than the relative permeability and/or permittivity in second substrate region 310. For example, a low permittivity in second substrate region 310 permits first portion 110 of feed line 105 to be low loss over a substantial portion of its length, while a high permittivity in the first substrate region 305 can improve coupling between the feed line 110 and the slot 125. Improved coupling characteristics between the feed line 105 and the slot 125 can enhance the efficiency of the antenna 100 by concentrating electromagnetic field energy between feed line 105 and slot 125. In one embodiment the relative permittivity in second substrate region 310 can be 2 to 3, while the relative permittivity in first substrate region 305 and third substrate region 315 can be at least 4. For example, the relative permittivity of first substrate region 305 and third substrate region 315 can be 4, 6, 8,10, 20, 30, 40, 50, 60 or higher, or values in between these values.

Stubs, such as stub portion 115, are typically used to tune out the excess reactance of the slot fed antennas. However, the impedance bandwidth of the stub is generally less than the impedance bandwidth of both the slot 125 and radiator patch 135 (if provided). Therefore, although conventional stubs can generally be used to tune out excess reactance of the antenna, the low impedance bandwidth of conventional stubs generally limits the bandwidth of the antenna. Using the invention, the stub impedance bandwidth can be improved by disposing stub portion 115 on the third substrate region 315, the third substrate region 315 having a high relative permittivity, such as at least 6.

Analogous to first substrate layer 150, second substrate layer 160 can be configured to provide differing substrate properties. In one embodiment, first portion 330 of the second substrate layer 160 can have higher permittivity than the second portion 335.

In the two radiator patch arrangement, controllable and localizable dielectric substrate parameters are preferably provided between the respective radiator patches 135 and 145 as well. This permits the antenna size, for a given operating frequency, to be reduced through dielectric loading of the patch. Thus, at least a first portion 340 of third substrate layer 170 can have higher permittivity than the second portion 345. Accordingly, the invention can provide an antenna having a smaller patch size for radiating at a desired frequency range. Dielectric loading can also be used for increasing the bandwidth of the radiator patches 135 and 145.

One problem with increasing the relative permittivity in the dielectric region beneath radiating elements, such as radiator patch 145, is that radiation efficiency of the antenna may be reduced as a result. Further, microstrip antennas printed on high permittivity and relatively thick substrates tend to exhibit poor radiation efficiency. With dielectric substrates having higher values of relative permittivity, a larger amount of the electromagnetic field is concentrated in the dielectric between the conductive antenna elements and the underlying conductor. Poor radiation efficiency under such circumstances is often attributed in part to surface wave modes propagating along the air/substrate interface.

Much of this efficiency reduction can be recovered by selectively increasing the relative permeability in substrate layers 150, 160 and 170. Increased permeability enhances field concentration within the antenna 100, thereby permitting a size reduction of the antenna 100 without the loss in antenna efficiency associated with the exclusive use of a high permittivity dielectric substrate portions.

Figure 4:
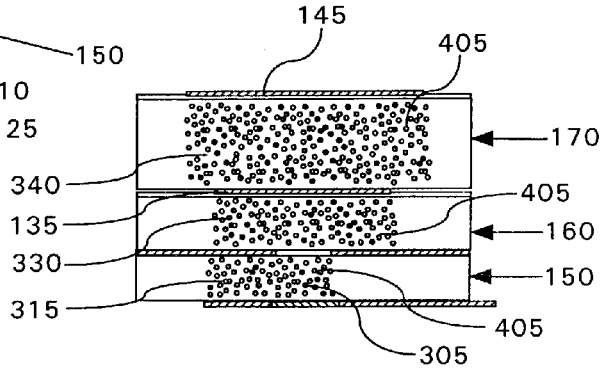
FIG. 4 is a section view of an alternate embodiment of the slot fed microstrip patch antenna of FIG. 1 taken along line 3—3 (with only one feed line shown for clarity).

The present invention allows inclusion of magnetic particles 405 within selected portions of dielectric substrates. For example, magnetic particles 405 are provided beneath patch 145 in substrate 170, as shown in FIG. 4. The magnetic particles 405 can provide substrate layers having one or more regions to provide significant magnetic permeability. Further, magnetic particles 405 can be added to the first substrate region 305 between feed line 105 and slot 125, the third substrate region 315 proximate to stub 115, and/or regions 330 and 340 of the second and third substrate layers 160 and 170 proximate to patches 135 and 145. As used herein, significant magnetic permeability refers to a relative magnetic permeability of at least about 2. As noted, conventional substrates materials have a relative magnetic permeability of approximately 1.

Magnetic particles 405 can be metamaterial particles, which can be placed in substrates by a variety of methods, such as inserting the particles into voids created in the substrate layers 150, 160 or 170. Substrates may be a ceramic or other substrate materials, as discussed in detail later. The ability to selectively add significant magnetic permeability to portions of the dielectric substrate can be used to generally increase the inductance of nearby conductive traces (such as transmission lines and antenna elements), specifically improve coupling between the feed lines 105, slot 125 and radiator patch 145, as well as improve the impedance match of the antenna to free space.

In general it has been found that as relative substrate permittivity of an antenna substrate increases beyond about 4, it is desirable to also increase the antenna substrate permeability in order for the antenna to better match, and as a result, more effectively transfer electromagnetic energy into free space. For greater radiation efficiency, it has been found that the relative permeability can be increased roughly in accordance with the square root of the local relative permittivity value. For example, if the substrate region 340 is configured to have a relative permittivity of 9, a good starting point for relative permeability in this region would be 3. Of course, those skilled in the art will recognize that the optimal values in any particular case will be dependent upon a variety of factors, including the precise nature of the dielectric structure above and below the antenna elements, the dielectric and conductive structure surrounding the antenna elements, the height of the antenna above the ground plane, area of the patch, and so on. Accordingly, a suitable combination of optimum values for permittivity and permeability can be determined experimentally and/or with computer modeling.

Thus, antenna 100 achieves improved efficiency, improved bandwidth and a reduction in physical size through at least three (3) inventive enhancements. As noted above, improved antenna efficiency and a reduction in size for a given operating frequency range is realized though one or more optimized antenna substrate layers. Antenna efficiency is further enhanced through enhanced coupling of electromagnetic energy between feed lines 105 and slot 125, and between slot 125 and patches 135 and 145 in microstrip patch antenna embodiments, through optimized substrates which provide a high localized permittivity regions 305. In addition, the substrate region 310 is optimized for low feed line loss. Finally, the bandwidth of the antenna, and in some applications the antenna efficiency, also can be optimized by improving the impedance bandwidth of stub portions 115.

Figure 5:
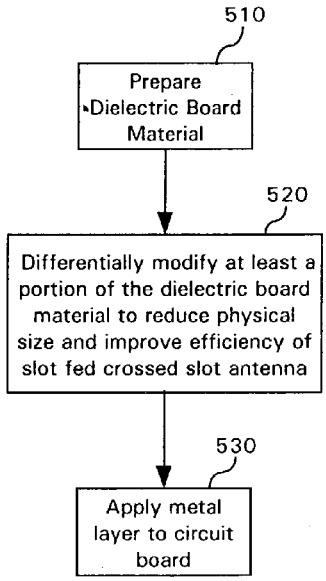
FIG. 5 is a flow chart that is useful for illustrating a process for manufacturing a crossed slot microstrip patch antenna having reduced size and improved coupling characteristics and bandwidth in accordance with the present invention.

Dielectric substrate boards having metamaterial portions providing localized and selectable magnetic and dielectric properties can be prepared as shown in FIG. 5 for use as customized antenna substrates. In step 510, the dielectric board material can be prepared. In step 520, at least a portion of the dielectric board material can be differentially modified using meta-materials, as described below, to reduce the physical size and achieve the best possible efficiency for the antenna and associated circuitry. The modification can include creating voids in a dielectric material and filling some or substantially all of the voids with magnetic particles. Finally, referring to step 530, a metal layer can be applied to define the conductive traces associated with the antenna elements and associated feed circuitry, such as radiator patches.

As defined herein, the term "meta-materials" refers to composite materials formed from the mixing or arrangement of two or more different materials at a very fine level, such as the angstrom or nanometer level. Meta-materials allow tailoring of electromagnetic properties of the composite, which can be defined by effective electromagnetic parameters comprising effective electrical permittivity $\epsilon_{eff}$ (or dielectric constant) and the effective magnetic permeability $\Phi_{eff}$.

The process for preparing and modifying the dielectric board material as described in steps 510 and 520 shall now be described in some detail. It should be understood, however, that the methods described herein are merely examples and the invention is not intended to be so limited.

Appropriate bulk dielectric ceramic substrate materials can be obtained from commercial materials manufacturers, such as DuPont and Ferro. The unprocessed material, commonly called Green Tape™, can be cut into sized portions from a bulk dielectric tape, such as into 6 inch by 6 inch portions. For example, DuPont Microcircuit Materials provides Green Tape material systems, such as 951 Low-Temperature Cofire Dielectric Tape and Ferro Electronic Materials ULF28-30 Ultra Low Fire COG dielectric formulation. These substrate materials can be used to provide dielectric layers having relatively moderate dielectric constants with accompanying relatively low loss tangents for circuit operation at microwave frequencies once fired.

In the process of creating a microwave circuit using multiple sheets of dielectric substrate material, features such as vias, voids, holes, or cavities can be punched through one or more layers of tape. Voids can be defined using mechanical means (e.g. punch) or directed energy means (e.g., laser drilling, photolithography), but voids can also be defined using any other suitable method. Some vias can reach through the entire thickness of the sized substrate, while some voids can reach only through varying portions of the substrate thickness.

The vias can then be filled with metal or other dielectric or magnetic materials, or mixtures thereof, usually using stencils for precise placement of the backfill materials. The individual layers of tape can be stacked together in a conventional process to produce a complete, multi-layer substrate. Alternatively, individual layers of tape can be stacked together to produce an incomplete, multi-layer substrate generally referred to as a sub-stack.

Voided regions can also remain voids. If backfilled with selected materials, the selected materials preferably include meta-materials. The choice of a metamaterial composition can provide controllable effective dielectric constants over a relatively continuous range from less than 2 to at least 2650. Controllable magnetic properties are also available from certain meta-materials. For example, through choice of suitable materials the relative effective magnetic permeability generally can range from about 4 to 116 for most practical RF applications. However, the relative effective magnetic permeability can be as low as about 2 or reach into the thousands.

A given dielectric substrate may be differentially modified. The term "differentially modified" as used herein refers to modifications, including dopants, to a dielectric substrate layer that result in at least one of the dielectric and magnetic properties being different at one portion of the substrate as compared to another portion. A differentially modified board substrate preferably includes one or more metamaterial containing regions. For example, the modification can be selective modification where certain dielectric layer portions are modified to produce a first set of dielectric or magnetic properties, while other dielectric layer portions are modified differentially or left unmodified to provide dielectric and/or magnetic properties different from the first set of properties. Differential modification can be accomplished in a variety of different ways.

According to one embodiment, a supplemental dielectric layer can be added to the dielectric layer. Techniques known in the art such as various spray technologies, spin-on technologies, various deposition technologies or sputtering can be used to apply the supplemental dielectric layer. The supplemental dielectric layer can be selectively added in localized regions, including inside voids or holes, or over the entire existing dielectric layer. For example, a supplemental dielectric layer can be used for providing a substrate portion having an increased effective dielectric constant. The dielectric material added as a supplemental layer can include various polymeric materials.

The differential modifying step can further include locally adding additional material to the dielectric layer or supplemental dielectric layer. The addition of material can be used to further control the effective dielectric constant or magnetic properties of the dielectric layer to achieve a given design objective.

The additional material can include a plurality of metallic and/or ceramic particles. Metal particles preferably include iron, tungsten, cobalt, vanadium, manganese, certain rare-earth metals, nickel or niobium particles. The particles are preferably nanometer size particles, generally having sub-micron physical dimensions, hereafter referred to as nano-particles. The particles can preferably be organofunctionalized composite particles. For example, organofunctionalized composite particles can include particles having metallic cores with electrically insulating coatings or electrically insulating cores with a metallic coating.

Magnetic metamaterial particles that are generally suitable for controlling magnetic properties of dielectric layer for a variety of applications described herein include ferrite organoceramics (FexCyHz)-(Ca/Sr/Ba-Ceramic). These particles work well for applications in the frequency range of 8–40 GHz. Alternatively, or in addition thereto, niobium organoceramics (NbCyHz)-(Ca/Sr/Ba-Ceramic) are useful for the frequency range of 12–40 GHz. The materials designated for high frequency are also applicable to low frequency applications. These and other types of composite particles can be obtained commercially.

In general, coated particles are preferable for use with the present invention as they can aid in binding with a polymer matrix or side chain moiety. In addition to controlling the magnetic properties of the dielectric, the added particles can also be used to control the effective dielectric constant of the material. Using a fill ratio of composite particles from approximately 1 to 70%, it is possible to raise and possibly lower the dielectric constant of substrate dielectric layer and/or supplemental dielectric layer portions significantly. For example, adding organofunctionalized nanoparticles to a dielectric layer can be used to raise the dielectric constant of the modified dielectric layer portions.

Particles can be applied by a variety of techniques including polyblending, mixing and filling with agitation. For example, a dielectric constant may be raised from a value of 2 to as high as 10 by using a variety of particles with a fill ratio of up to about 70%. Metal oxides useful for this purpose can include aluminum oxide, calcium oxide, magnesium oxide, nickel oxide, zirconium oxide and niobium (II, IV and V) oxide. Lithium niobate ($LiNbO_3$), and zirconates, such as calcium zirconate and magnesium zirconate, also may be used.

The selectable dielectric properties can be localized to areas as small as about 10 nanometers, or cover large area regions, including the entire board substrate surface. Conventional techniques such as lithography and etching along with deposition processing can be used for localized dielectric and magnetic property manipulation.

Materials can be prepared mixed with other materials or including varying densities of voided regions (which generally introduce air) to produce effective relative dielectric constants in a substantially continuous range from 2 to about 2650, as well as other potentially desired substrate properties. For example, materials exhibiting a low dielectric constant (<2 to about 4) include silica with varying densities of voided regions. Alumina with varying densities of voided regions can provide a relative dielectric constant of about 4 to 9. Neither silica nor alumina have any significant magnetic permeability. However, magnetic particles can be added, such as up to 20 wt. %, to render these or any other material significantly magnetic. For example, magnetic properties may be tailored with organofunctionality. The impact on dielectric constant from adding magnetic materials generally results in an increase in the dielectric constant.

Medium dielectric constant materials have a relative dielectric constant generally in the range of 70 to 500+/−10%. As noted above these materials may be mixed with other materials or voids to provide desired effective dielectric constant values. These materials can include ferrite doped calcium titanate. Doping metals can include magnesium, strontium and niobium. These materials have a range of 45 to 600 in relative magnetic permeability.

For high dielectric constant applications, ferrite or niobium doped calcium or barium titanate zirconates can be used. These materials have a relative dielectric constant of about 2200 to 2650. Doping percentages for these materials are generally from about 1 to 10%. As noted with respect to other materials, these materials may be mixed with other materials or voids to provide desired effective dielectric constant values.

These materials can generally be modified through various molecular modification processing. Modification processing can include void creation followed by filling with materials such as carbon and fluorine based organo functional materials, such as polytetrafluoroethylene PTFE.

Alternatively or in addition to organofunctional integration, processing can include solid freeform fabrication (SFF), photo, UV, x-ray, e-beam or ion-beam irradiation. Lithography can also be performed using photo, UV, x-ray, e-beam or ion-beam radiation.

Different materials, including meta-materials, can be applied to different areas on substrate layers (sub-stacks), so that a plurality of areas of the substrate layers (sub-stacks) have different dielectric and/or magnetic properties. The backfill materials, such as noted above, may be used in conjunction with one or more additional processing steps to attain desired dielectric and/or magnetic properties, either locally or over a bulk substrate portion.

A top layer conductor print is then generally applied to the modified substrate layer, sub-stack, or complete stack. Conductor traces can be provided using thin film techniques, thick film techniques, electroplating or any other suitable technique. The processes used to define the conductor pattern include, but are not limited to standard lithography and stencil.

A base plate is then generally obtained for collating and aligning a plurality of modified board substrates. Alignment holes through each of the plurality of substrate boards can be used for this purpose.

The plurality of layers of substrate, one or more sub-stacks, or combination of layers and sub-stacks can then be laminated (e.g. mechanically pressed) together using either isostatic pressure, which puts pressure on the material from all directions, or uniaxial pressure, which puts pressure on the material from only one direction. The laminate substrate is then further processed as described above or placed into an oven to be fired to a temperature suitable for the processed substrate (approximately 850° C. to 900° C. for the materials cited above).

The plurality of ceramic tape layers and stacked sub-stacks of substrates can then be fired, using a suitable furnace that can be controlled to rise in temperature at a rate suitable for the substrate materials used. The process conditions used, such as the rate of increase in temperature, final temperature, cool down profile, and any necessary holds, are selected mindful of the substrate material and any material backfilled therein or deposited thereon. Following firing, stacked substrate boards, typically, are inspected for flaws using an acoustic, optical, scanning electron, or X-ray microscope.

The stacked ceramic substrates can then be optionally diced into cingulated pieces as small as required to meet circuit functional requirements. Following final inspection, the cingulated substrate pieces can then be mounted to a test fixture for evaluation of their various characteristics, such as to assure that the dielectric, magnetic and/or electrical characteristics are within specified limits.

Thus, dielectric substrate materials can be provided with localized selected dielectric and/or magnetic characteristics for improving the density and performance of circuits, including those comprising microstrip antennas, such as crossed slot fed microstrip antennas.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

What is claimed is:

1. A crossed slot fed microstrip antenna, comprising:

a conducting ground plane, said conducting ground plane having at least one crossed slot;

at least two feed lines, said feed lines having respective stub regions extending beyond said crossed slot, each said feed line for transferring signal energy to or from said feed line through a slot of said crossed slot, said feed lines phased to provide a multi-polarization emission pattern; and a first substrate having a first region and at least a second region, said first substrate disposed between said ground plane and said feed lines;

wherein said first region comprises meta-material and has different substrate properties than said second region, and said first region is proximate to at least one of said feed lines.

2. The crossed slot fed microstrip antenna of claim 1, further comprising at least one radiator patch positioned above said ground plane and at least a second substrate sandwiched between said radiator patch and said ground plane, wherein said feed lines transfer signal energy to or from said radiator patch through said crossed slot and said second substrate.

3. The crossed slot fed microstrip antenna of claim 2, wherein said second substrate has at least a portion having a permeability greater than 1.

4. The crossed slot fed microstrip antenna of claim 3, wherein said second substrate includes magnetic particles.

5. The antenna of claim 1, wherein said at least two feed lines comprises 4 feed lines.

6. A crossed slot fed microstrip antenna, comprising:

a conducting ground plane, said conducting ground plane having at least one crossed slot;

at least two feed lines, said feed lines having respective stub regions extending beyond said crossed slot, each said feed line for transferring signal energy to or from said feed line through a slot of said crossed slot, said feed lines phased to provide a multi-polarization emission pattern;

a first substrate having a first region and at least a second region, said first substrate disposed between said ground plane and said feed lines;

wherein said first region has different substrate properties than said second region and said first region is proximate to at least one of said feed lines; and wherein said first set of substrate properties comprises at least one of a first permittivity and a first permeability and said second set of substrate properties comprises at least one of a second permittivity and a second permeability.

7. The crossed slot fed microstrip antenna of claim 6 wherein said first permeability is different than said second permeability.

8. The crossed slot fed microstrip antenna of claim 6 wherein said first permeability is higher than said second permeability.

9. The crossed slot fed microstrip antenna of claim 6 wherein said first permeability is between 1 and 10 and said second permeability is about 1.

10. The crossed slot fed microstrip antenna of claim 6 wherein said first permittivity is different than said second permittivity.

11. The crossed slot fed microstrip antenna of claim 6 wherein said first permittivity is higher than said second permittivity.

* * * * *